US007311044B1

(12) United States Patent
Hirst et al.

(10) Patent No.: US 7,311,044 B1
(45) Date of Patent: Dec. 25, 2007

(54) IMAGING DEVICE COOLING SYSTEM

(75) Inventors: Mark Hirst, Boise, ID (US); Richard Lee Swantner, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 6 days.

(21) Appl. No.: 10/685,322

(22) Filed: Oct. 14, 2003

(51) Int. Cl.
*B41F 1/54* (2006.01)

(52) U.S. Cl. ..... 101/484; 136/205; 399/94

(58) Field of Classification Search ..... 347/102, 347/224; 361/200, 201, 103; 101/483, 480, 101/484; 399/93, 94; 372/29.012, 29.015, 372/34, 36; 136/203, 205, 208–212
See application file for complete search history.

(56) References Cited

U.S. PATENT DOCUMENTS 4,072,825 A * 2/1978 McLay et al. ..... 379/33
5,073,796 A * 12/1991 Suzuki et al. ..... 399/93
5,419,780 A * 5/1995 Suski ..... 136/205
5,596,228 A 1/1997 Anderton et al.
5,644,184 A * 7/1997 Kucherov ..... 310/306
5,715,509 A 2/1998 Staudenmayer et al.
5,812,906 A 9/1998 Staudenmayer et al.
5,875,206 A * 2/1999 Chang ..... 372/75
6,100,463 A * 8/2000 Ladd et al. ..... 136/201
6,125,636 A 10/2000 Taylor et al.
6,193,349 B1 2/2001 Cornell et al.
6,346,668 B1 * 2/2002 McGrew ..... 136/200
6,401,462 B1 6/2002 Bielinski
6,403,874 B1 * 6/2002 Shakouri et al. ..... 136/201
6,428,170 B1 8/2002 Haba
6,648,530 B2 * 11/2003 Kamei et al. ..... 400/472
2003/0133492 A1 7/2003 Watanabe
2003/0184941 A1 * 10/2003 Maeda et al. ..... 361/103
2004/0041892 A1 * 3/2004 Yoneyama et al. ..... 347/102

FOREIGN PATENT DOCUMENTS

JP 01120342 A * 5/1989
JP 2004272131 A * 9/2004

* cited by examiner

*Primary Examiner*—Ren Yan

(57) ABSTRACT

One embodiment of the present invention provides a cooling system in an imaging device having an element that generates heat. The cooling system comprises a thermoelectric generator and a cooling device. The thermoelectric generator is thermally coupled to the element to convert the heat generated by the element to electrical energy. The cooling device is powered by the electrical energy to thereby cool the imaging device.

36 Claims, 3 Drawing Sheets

IMAGING DEVICE COOLING SYSTEM

CROSS REFERENCE TO RELATED APPLICATIONS

This patent application is related to U.S. patent application Ser. No. 10/684,634 filed concurrently herewith and entitled "APPARATUS HAVING ACTUATING MEMBER," and U.S. patent application Ser. No. 10/989,464 entitled "INDICATING SYSTEM," filed concurrently herewith and incorporated herein by reference.

BACKGROUND

Electrophotographic imaging devices, such as laser printers, fax machines, and photocopiers, are designed to produce a desired image on a print media, such as a sheet of copy paper. Electrostatic imaging devices generally include a photoconductive element that is selectively discharge by illumination from a scanned laser beam or light emitting diode array in response to data representative of the desired image that is to be produced, wherein the incident light generates a latent electrostatic copy of the desired image on the photoconductive element. The latent electrostatic copy is then developed by first exposing the photoconductive element to toner powder that adheres to the discharged portions of the photoconductive element and subsequently transferring the toner powder from the photoconductive element to the print media. The "loose" toner powder is then fused to the print media by a fuser unit.

Fuser units typically employ a combination of heat and pressure to fuse the toner powder to the print media. A fusing unit may employ a pair of opposing rollers that form a fusing nip, with one roller serving as a fuser roller and the other roller serving as a pressure roller. The fuser roller generally contacts the un-fused toner, while the pressure roller applies a pressure, or nip force, at the fusing nip to hold the print media in contact with the fuser roller. The fuser roller is generally heated while the pressure roller may or may not be heated. To fuse the looser toner to the print media, a fuser motor rotates the fuser and pressure rollers in a forward direction causing the print media to be drawn through the fusing nip, at which point the combination of pressure and heat from the rollers melts the loose toner and permanently affixes it to the print media.

In order to properly fuse the loose toner to the print media, fuser units are generally maintained at temperatures between 150° C. and 200° C. and may store a large amount of heat energy even after the associated imaging device is powered-off. In some instances, the amount of stored heat energy may be so large that the fuser unit may remain at high temperatures for several tens of minutes and potentially damage imaging system components if not properly dissipated. For instance, if the platen rollers are not properly cooled, waste toner powder may potentially fuse to the roller surfaces or other imaging system components, or rising temperatures may damage photoconductors or partially fuse toner reservoirs, causing them to become sources of potential print defects.

SUMMARY

One embodiment of the present invention provides a cooling system in an imaging device having an element that generates heat. The cooling system comprises a thermoelectric generator and a cooling device. The thermoelectric generator is thermally coupled to the element to convert the heat generated by the element to electrical energy. The cooling device is powered by the electrical energy to thereby cool the imaging device.

DETAILED DESCRIPTION

In the following detailed description of the embodiments, reference is made to the accompanying drawings which form a part hereof, and in which is shown by way of illustration specific embodiments. It is to be understood that other embodiments may be utilized and structural or logical changes may be made without departing from the scope of the claims. The following detailed description, therefore, is not to be taken in a limiting sense, and the scope of the present invention is defined by the appended claims.

Figure 1:
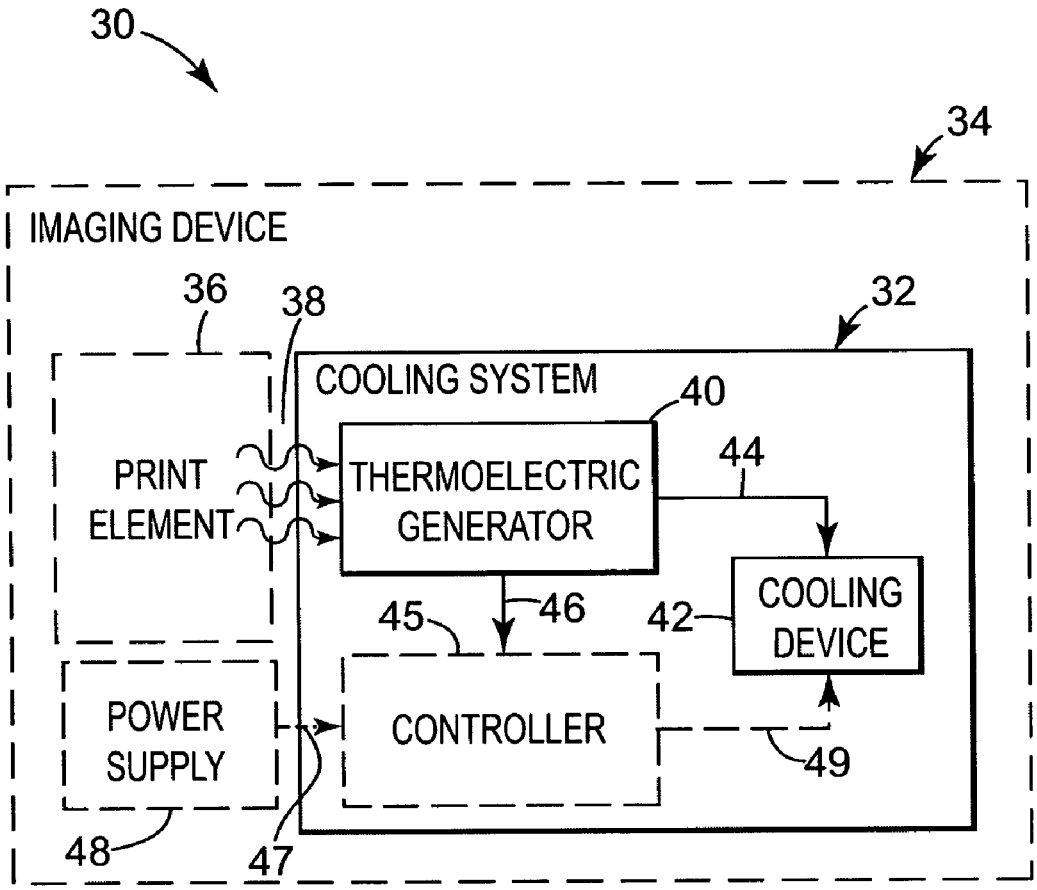
FIG. 1 is a diagram illustrating one embodiment of a cooling system in an imaging device.

FIG. 1 illustrates generally at 30 one exemplary embodiment of a cooling system 32 for an imaging device 34 that includes a print element 36 that generates heat 38. Cooling system 32 further comprises a thermoelectric generator 40 and a cooling device 42. Thermoelectric generator 40 is adapted to and positioned so as to be thermally coupled to print element 36. Thermoelectric generator 40 is configured to convert to electrical energy the heat 38 from print element 36. Cooling device 42 is powered by the electrical energy via a path 44 and cools imaging device 34. In one embodiment, the electrical energy provided by thermoelectric generator 40 is a voltage. In one embodiment, cooling device 42 comprises at least one exhaust fan positioned so as to create an air flow to remove heat from and reduce the temperature of print element 36.

In one embodiment, cooling system 32 further comprises a controller 45. Thermoelectric generator 40 is configured to provide the electrical energy converted from heat 38 to controller via a path 46 rather than to cooling device 42 via path 44. Controller 45 is adapted to receive and monitor a level of electrical energy received via a path 47 from a power supply 48 integral to imaging device 34. Controller 45 is further configured via path 49 to cause cooling device 42 to be normally powered by the electrical energy from power supply 48 and to be alternately powered by the electrical energy from thermoelectric generator 40 upon detecting that the level of electrical energy received from power supply 48 is at a level substantially equal to zero (i.e., a loss of power).

By utilizing heat (that would otherwise be wasted) to provide cooling, cooling system 32 can provide additional cooling capacity to imaging device 34 without substantially increasing the power consumption of imaging device 34. Additionally, cooling system 32 can continue to provide cooling to imaging device 34 even after a power loss. Thus, cooling system 32 could operate without using batteries, which are costly and may need periodic servicing or replacement. The use of cooling system 32 could reduce the electrical load on power supply 48 below that used by a cooling system supplied by power supply 48. This reduction in electrical load allows the power supply to be reduced in size or free-up capacity that could be utilized for other functions of imaging device 34.

In one embodiment, thermoelectric generator 40 comprises a Peltier device operating in a Seebeck mode to generate a voltage to operate cooling device 42. In a Peltier device, when a current is circulated through a series loop formed by joining two wires of different materials, one junction generates heat while the other junction absorbs heat (becomes cool). When the current is reversed, the heat generating and absorbing junctions are reversed. Peltier devices can function as thermoelectric generators. That is, when a temperature differential is applied across the junctions, the Peltier device generates a DC voltage between the junctions. This mode of operation is known as the Seebeck mode. Peltier devices may be comprised of heavily doped series-connected semiconductor segments, as described, for example, by Brun et al., U.S. Pat. No. 4,929,282; Cauchy, U.S. Pat. No. 5,448,109; and Chi et al., U.S. Pat. No. 5,714,791.

Figure 2:
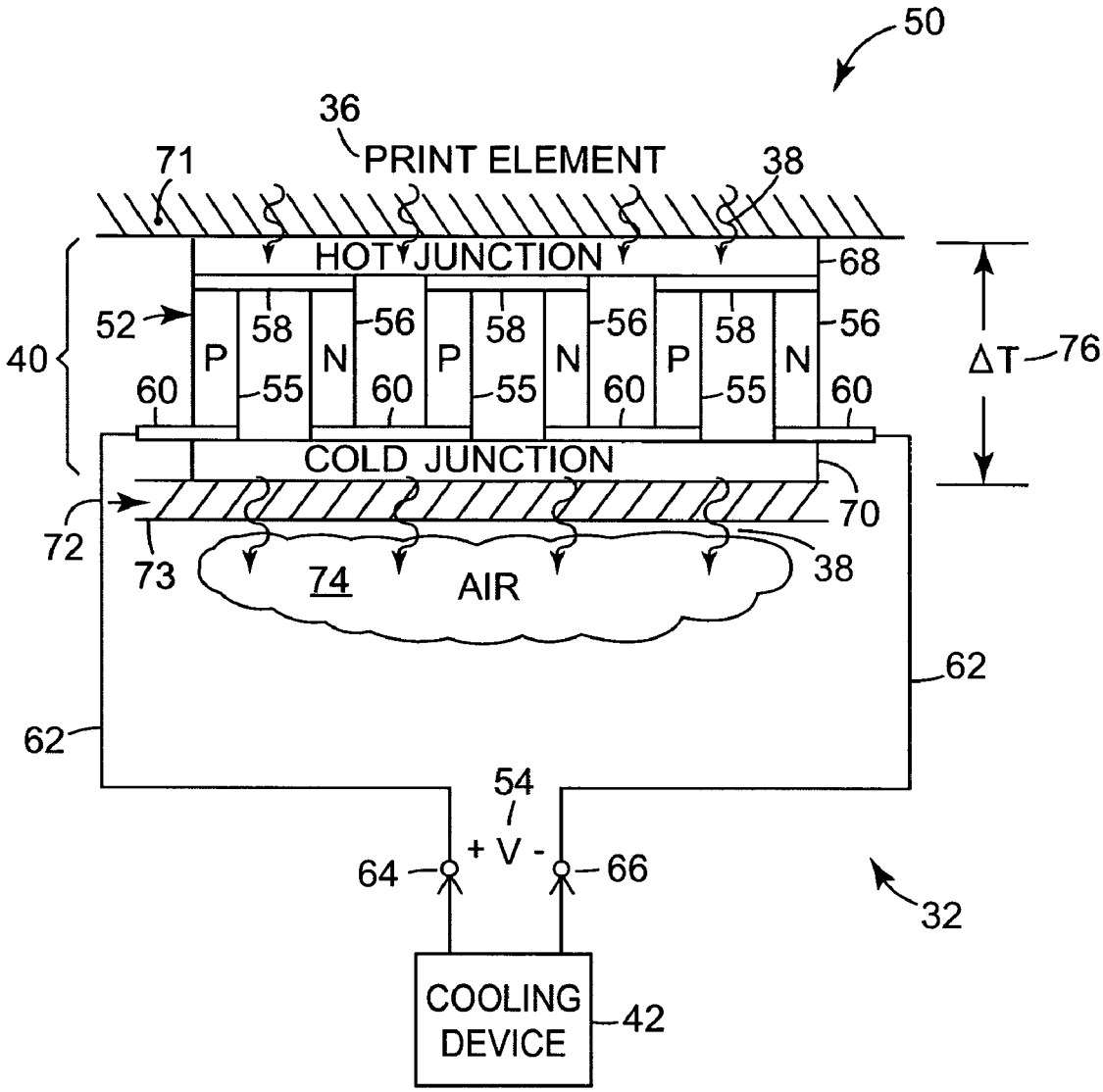
FIG. 2 is a diagram illustrating one embodiment of a thermoelectric generator as employed by a cooling system.

FIG. 2 illustrates at 50, one embodiment of cooling system 32 wherein thermoelectric generator 40 comprises a Peltier device 52, operating in the Seebeck mode to generate an output voltage 54 to power cooling device 42. Peltier device 52 comprises a plurality of p-doped semiconductor segments 55 and a plurality of n-doped semiconductor segments 56, each segment having a first and a second end. The p-doped segments create an excess of electrons, while the n-doped segments create a deficiency of electrons. The p-doped segments 55 and n-doped segments 56 are connected in an alternating series fashion, with their first ends connected by a first plurality of conductor segments 58 and their second ends connected by a second plurality of conductor segments 60, wherein the first and second pluralities of conductor segments 58 and 60 comprise an electrically conductive materials such as copper. The first and last conductor segment of the plurality of conductor segments 60 are connected to a pair of wires 62 to provide output voltage 54 at a pair of output terminals 64 and 66. Cooling device 42 is coupled across terminals 64 and 66 and operated by output voltage 54.

The first plurality of conductor segments 58 is coupled to a hot junction 68 and the second plurality of conductor segments 60 is coupled to a cold junction 70. Hot junction 68 and cold junction 70 comprise a material that is thermally conductive or highly thermally conductive, but electrically non-conductive, including a ceramic material such as alumina or aluminum nitride. Hot junction 68 is thermally coupled to an exterior surface 71 of print element 36 and cold junction 70 is thermally coupled to first surface of a housing 72 of imaging device 34, wherein an opposite surface is in contact with air 74 at an ambient room temperature. In one embodiment, thermoelectric generator 40 is mechanically coupled to housing 72 such that cold junction 70 is thermally coupled to housing 72. Essentially, print element 36 functions as a heat source transferring heat 38 to hot junction 68, while printer housing 72 functions as a heat sink transferring heat 38 from cold junction 70 to outside air 74.

In operation, when imaging device 34 is powered-up, and for a period of several tens of minutes after it is powered-off, the temperature of print element 36 rises to a temperature greater than the ambient room temperature of air 74, thereby creating a temperature differential 76 between hot junction 68 and cold junction 70. Typically, exterior surface 71 of print element 36 has an operating temperature in excess of 100° C. and the temperature of ambient air 74 is typically in the rang of 20° C. Thus, a temperature differential 76 of at least 60° C. is present across thermoelectric generator 40. It is temperature differential 76 between hot junction 68 and cold junction 70 that, according to the Seebeck Effect, results in Peltier device 52 generating output voltage 54 across terminals 64 and 66. Output voltage 54 is proportional to temperature differential 76, with an increase in temperature differential 76 resulting in an increase in output voltage 54. Thus, in an embodiment where cooling device 42 is an exhaust fan, an increase in temperature differential 76 will automatically result in an increase in cooling providing by exhaust fan 42. In this respect, cooling system 32 is self-adjusting.

Figure 3:
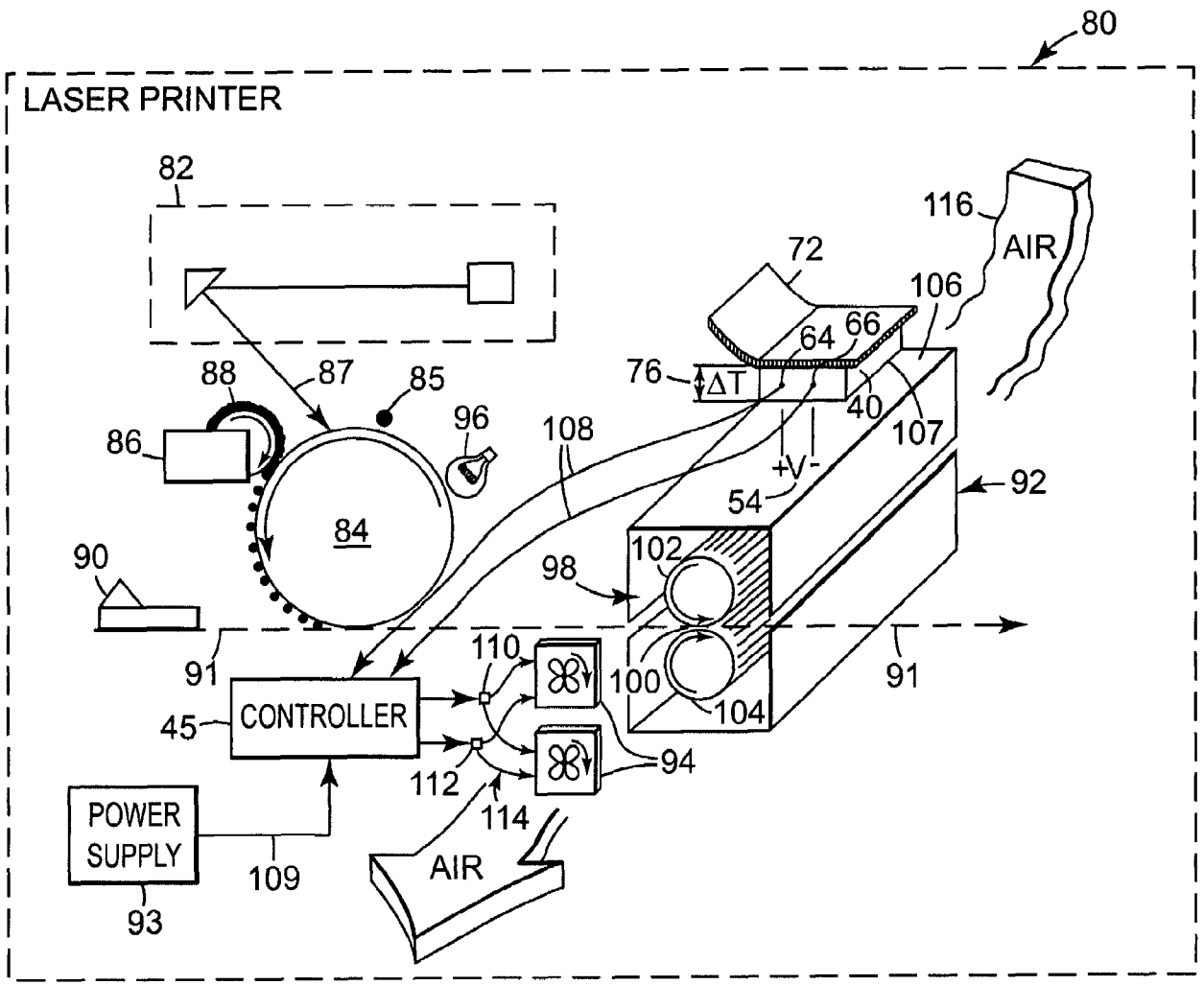
FIG. 3 is a schematic diagram illustrating a laser printer having a cooling system.

FIG. 3 illustrates one exemplary embodiment of a laser printer 80. Laser printer 80 includes a cooling system configured to convert heat from a fuser unit to electrical energy to power a cooling fan to provide cooling to the fuser unit. Laser printer 80 includes a laser scanning unit 82, a photoconductive drum 84, a charging station 85, a toner hopper 86, a developer roller 88, a paper source 90, a fuser unit 92, a power supply 93, exhaust fans 94, a thermoelectric generator 40, a controller 45, and a sheet metal housing 72.

To produce an image, photoconductive drum 84 is given a total positive charge by charging station 85. Laser scanning unit 82 selectively illuminates photoconductive drum 84 with a light beam 87. As photoconductive drum 84 rotates, the incident light beam 87 discharges the portions of the surface of photoconductive drum 84 and creates an electrostatic copy of the image on the surface of photoconductive drum 84. While photoconductive drum 84 rotates, developer roller 88 applies toner from the toner hopper 86 which adheres to the electrostatic copy of the image on the drum's surface. A piece of copy paper is fed from paper source 90 along a paper path 91 and the "loose" toner in the form of the image is transferred from the surface of the photoconductive drum 84 to a surface of the copy paper as it passes the drum. A discharge lamp 96 "erases" the electrostatic copy of the image from the surface of photoconductive drum 84.

The copy paper continues along paper path 91 to fuser unit 92. Fuser unit 91 includes a pair of opposing platen rollers 98 that form a fusing nip 100, with one roller being a fuser roller 102 and the other being an idler pressure roller 104. Fuser roller 102 is heated and contacts the loose toner on the surface of the copy paper, while idler pressure roller 104 applies pressure at fusing nip 100 to hold the copy paper in contact with fuser roller 102 and to impart a smooth and even finish to the surface of the fused toners. To melt and fuse the loose toner to the copy paper, fuser roller 102 is typically maintained at a temperature between 150° C. and 200° C., with a fuser surface 106 of fuser unit 92 having a temperature in excess of 100° C.

Thermoelectric generator 40 has a first surface thermally coupled to fuser surface 106 and a second surface thermally coupled to surface 73 of sheet metal housing 72 of laser printer 80. In one embodiment, a heat-conducting elastomer is adhered to the first surface of thermoelectric generator to improve heat transfer between thermoelectric generator 40 and fuser unit 92. Elastomer 107 allows fuser unit 92 to be removed from or installed in laser printer 80 while ensuring a good thermal coupling between fuser unit 82 and thermoelectric generator 40. Surface 73 of sheet metal housing 72 typically has a temperature in the range of 40° C., which creates a temperature gradient 76 of at least 60° C. across thermoelectric generator 40. In one embodiment, the second surface of thermoelectric generator is mechanically and thermally coupled to sheet metal housing 72 and the first surface is only thermally coupled to fuser surface 106, thereby allowing removal of fuser 92 from laser printer 80.

Thermoelectric generator 40 converts temperature differential 76 to output voltage 54 at terminals 64 and 66.

Controller 45 receives output voltage 54 via a pair of wires 108 and a power supply voltage via path 109 from power supply 93. Exhaust fans 94 are coupled to output terminals 110 and 112 of controller 45 via wires 114 which operate to circulate air 116 across fuser unit 92 to thereby regulate the temperature of fuser unit 92. When the power supply voltage is present via path 109, controller 45 provides the power supply voltage at output terminal 110 and 112 to power exhaust fans 94. When controller 45 detects that the power supply voltage received via path 109 has dropped to a level substantially equal to zero, controller 45 provides output voltage 54 provided by thermoelectric generator 40 at output terminal 110 and 112 to power exhaust fans 94. Thermoelectric generator 40 continues to provide power to operate exhaust fans 94 until temperature gradient 76 drops below a minimum threshold level. Thus, laser printer 80 employing a cooling system is capable of continuing to cool fuser unit 92 even after a loss of electrical power.

Cooling system 32 can provide additional cooling capacity to an imaging device having a print element that generates heat without increasing power consumption of the imaging device. Additionally, cooling system 32 can potentially reduce the electrical load on a power supply used to provide power to the imaging device, which allows the power supply to either be reduced in size or provide power to other imaging device components. Furthermore, cooling system 32 is capable of providing cooling even after a loss of power to the imaging device without the use of chemical batteries.

Although specific embodiments have been illustrated and described herein, it will be appreciated by those of ordinary skill in the art that a wide variety of alternate and/or equivalent implementations may be substituted for the specific embodiments shown and described without departing from the scope of the claims. Those with skill in the chemical, mechanical, electro-mechanical, electrical, and computer arts will readily appreciate that the principles of the disclosure may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A cooling system in a print imaging device having an element that generates heat, the cooling system comprising:

a thermoelectric generator thermally coupled to the element to convert heat from the element to electrical energy, wherein a first surface of the thermoelectric generator is mechanically coupled and thermally coupled to a housing of the imaging device and a second surface is thermally coupled only to the element to thereby allow removal of the element from the imaging device;

a cooling device powered by the electrical energy to thereby cool the print imaging device; and a controller adapted to receive and configured to monitor a level of electrical energy from a power supply internal to the imaging device, configured to receive the electrical energy from the thermoelectric generator, and configured to cause the cooling device to be normally powered by the electrical energy from the power supply and to be alternately powered by the electrical energy from the thermoelectric generator upon detecting the level of electrical energy from the power supply is substantially at or below a threshold level.

2. The cooling system of claim 1, wherein the threshold level is substantially equal to zero.

3. The cooling system of claim 1, wherein the controller is further configured to cause the cooling device to be alternately powered by the electrical energy from the thermoelectric generator upon detecting that electrical energy from the thermoelectric generator is at a level greater than the level of electrical energy from the power supply.

4. The cooling system of claim 1, wherein the thermoelectric generator comprises:

a Peltier device operating in a Seebeck mode.

5. The cooling system of claim 1, wherein a heat conducting elastomer has a first major surface adhered to the second surface of the thermoelectric generator and a second major surface that contacts the element.

6. The cooling system of claim 1, wherein the electrical energy comprises a voltage.

7. The cooling system of claim 1, wherein the cooling device is configured to reduce the temperature of the element.

8. The cooling system of claim 1, wherein the cooling device comprises at least one exhaust fan to generate an air flow.

9. A print imaging system comprising:

a heat source;

a cooling system comprising:

a thermoelectric generator thermally coupled to the heat source to convert heat from the heat source to electrical energy, wherein a first surface of the thermoelectric generator is mechanically coupled and thermally coupled to a housing of the print imaging system and a second surface is thermally coupled only to the heat source; and a cooling device powered by the electrical energy to thereby cool the print imaging system; and a controller adapted to receive and configured to monitor a level of electrical energy from a power supply internal to the imaging system, configured to receive the electrical energy from the thermoelectric generator, and configured to cause the cooling device to be normally powered by the electrical energy from the power supply and to be alternately powered by the electrical energy from the thermoelectric generator upon detecting the level of electrical energy from the power supply is substantially at or below a threshold level.

10. The imaging system of claim 9, wherein the threshold level is substantially equal to zero.

11. The imaging system of claim 9, wherein the controller is further configured to cause the cooling device to be alternately powered by the electrical energy from the thermoelectric generator upon detecting that electrical energy from the thermoelectric generator is at a level greater than the level of electrical energy from the power supply.

12. The imaging system of claim 9, wherein the heat source comprises a print element.

13. The imaging system of claim 9, wherein the thermoelectric generator comprises:

a Peltier device operating in a Seebeck mode.

14. The imaging system of claim 9, wherein a heat conducting elastomer has a first major surface adhered to the second surface of the thermoelectric generator and a second major surface that contacts the heat source.

15. The imaging system of claim 9, wherein the electrical energy comprises a voltage.

16. The imaging system of claim 9, wherein the cooling device is configured to reduce the temperature of the heat source.

17. The imaging system of claim 9, wherein the cooling device comprises at least one exhaust fan that generates an air flow.

18. A laser printer comprising:

a fuser that generates heat;

a cooling system comprising:

a thermoelectric generator thermally coupled to the fuser to convert heat from the fuser to electrical energy, wherein the thermoelectric generator has a first surface mechanically coupled and thermally coupled to a housing of the laser printer and a second surface thermally coupled only to the fuser to thereby allow removal of the fuser from the laser printer; and a cooling device powered by the electrical energy to thereby cool the laser printer; and a controller adapted to receive and configured to monitor a level of electrical energy from a power supply internal to the laser printer, configured to receive the electrical energy from the thermoelectric generator, and configured to cause the cooling device to be normally powered by the electrical energy from the power supply and to be alternately powered by the electrical energy from the thermoelectric generator upon detecting the level of electrical energy from the power supply is substantially at or below a threshold level.

19. The laser printer of claim 18, wherein the threshold level is substantially equal to zero.

20. The laser printer of claim 18, wherein the controller is further configured to cause the cooling device to be alternately powered by the electrical energy from the thermoelectric generator upon detecting that electrical energy from the thermoelectric generator is at a level greater than the level of electrical energy from the power supply.

21. The laser printer of claim 18, wherein the thermoelectric generator comprises:

a Peltier device operating in a Seebeck mode.

22. The laser printer of claim 18, wherein a heat conducting elastomer has a first major surface adhered to the second surface of the thermoelectric generator and a second major surface that contacts the fuser.

23. The laser printer of claim 18, wherein the electrical energy comprises a voltage.

24. The laser printer of claim 18, wherein the cooling device is configured to reduce the temperature of the fuser.

25. The laser printer of claim 18, wherein the cooling device comprises at least one exhaust fan that generates an air flow.

26. A fuser system suitable for use with an imaging system, the fuser system comprising:

a fuser assembly that generates heat;

a cooling system comprising:

a thermoelectric generator thermally coupled to the fuser assembly to convert heat from the fuser assembly to electrical energy, wherein the thermoelectric generator has a first surface mechanically coupled and thermally coupled to a housing of the imaging system and a second surface thermally coupled only to the fuser assembly to thereby allow removal of the fuser assembly from the fuse system; and a cooling device powered by the electrical energy to thereby cool the fuser assembly; and a controller adapted to receive and configured to monitor a level of electrical energy from a power supply, configured to receive the electrical energy from the thermoelectric generator, and configured to cause the cooling device to be normally powered by the electrical energy from the power supply and to be alternately powered by the electrical energy from the thermoelectric generator upon detecting the level of electrical energy from the power supply is substantially at or below a threshold level.

27. The fuser system of claim 26, wherein the threshold level is substantially equal to zero.

28. The fuser system of claim 26, wherein the controller is further configured to cause the cooling device to be alternately powered by the electrical energy from the thermoelectric generator upon detecting that electrical energy from the thermoelectric generator is at a level greater than the level of electrical energy from the power supply.

29. The fuser system of claim 26, wherein the thermoelectric generator comprises:

a Peltier device operating in a Seebeck mode.

30. The fuser system of claim 26, wherein a heat conducting elastomer has a first major surface adhered to the second surface of the thermoelectric generator and a second major surface that contacts the fuser assembly.

31. The fuser system of claim 26, wherein the electrical energy comprises a voltage.

32. The fuser system of claim 26, wherein the cooling device is configured to reduce the temperature of the fuser.

33. The fuser system of claim 26, wherein the cooling device comprises at least one exhaust fan that generates an air flow.

34. A method of cooling a print imaging device comprising:

positioning a thermoelectric generator so as to have a first surface mechanically and thermally coupled to housing of the print imaging device and a second surface only thermally coupled to a print element of the print imaging device, wherein the thermoelectric generator converts heat from the print element to electrical energy;

cooling the print imaging device with a cooling device;

monitoring a level of electrical energy provided by a power supply; and powering the cooling device normally with the electrical energy from the power supply and alternately powering the cooling device with the electrical energy from the converting upon detecting a level of electrical energy from the power supply is at or below a threshold level.

35. The method of claim 34, further comprising:

positioning the cooling device proximate to the print element to reduce the temperature of the print element.

36. A cooling system in an imaging device having a print element that generates heat, the cooling system comprising:

means for converting heat generated by the print element to electrical energy;

means for both mechanically and thermally coupling a first surface of the means for converting heat to a housing of the imaging device and for only thermally coupling a second surface of the means for converting heat to the print element;

means for monitoring a level of electrical energy from a power supply; and means for cooling the imaging device that is normally powered by the electrical energy from the power supply and alternately powered by the electrical energy from the heat converting means upon detecting a level of electrical energy from the power supply is at or below a threshold level.

* * * * *